United States Patent [19]

Quearry

[11] 4,252,079

[45] Feb. 24, 1981

[54] APPARATUS FOR TREATING MOP HEADS AND THE LIKE

[75] Inventor: Robert W. Quearry, Raytown, Mo.

[73] Assignee: Golden Star Inc., North Kansas City, Mo.

[21] Appl. No.: 67,125

[22] Filed: Aug. 16, 1979

[51] Int. Cl.[3] ..... B05C 1/02

[52] U.S. Cl. ..... 118/249; 15/102

[58] Field of Search ..... 118/DIG. 17, 249, 250, 118/13; 15/257.05, 102; 68/202

[56] References Cited

U.S. PATENT DOCUMENTS

| | | | |
|---|---|---|---|
| 707,289 | 8/1902 | Weston | 118/249 |
| 2,517,263 | 8/1950 | Voorhies | 118/249 |
| 4,073,263 | 2/1978 | Melton | 118/249 |
| 4,107,815 | 8/1978 | Dumesnil, Jr. | 15/257.05 |

OTHER PUBLICATIONS

Dustrol Mark III Moplicator Brochure.
Dustrol Mark IIIA Moplicator Brochure.
Mitey Mark, Compact Mop Treating Machine Brochure.

*Primary Examiner*—John P. McIntosh
*Attorney, Agent, or Firm*—Fishburn, Gold and Litman

[57] ABSTRACT

A lightweight, easily portable apparatus for treating a mop head, dust cloth and the like with a dust attracting liquid includes a lightweight plastic container having spaced walls and an open top for holding a quantity of the liquid and a lightweight, removable frame structure fitted onto the container whereby the frame structure is separable from the container for cleaning, storage and handling. The frame structure has a front portion with a plate member thereon for supporting the mop head and said plate may be transparent whereby the condition and quantity of liquid in the container can be visually determined. Spaced arm members are connected to a rear portion of the frame structure adjacent opposite side walls of the container and have lower portions extending downwardly into the interior of the container and upper portions extending upwardly from the container. Horizontally disposed upper and lower roller members are rotatably supported on the arm members, the lower roller member being adjacent to the lower portions and having contact with the liquid for coating thereby and the upper roller member being movably mounted in the upper portions for movement toward and away from contact with the lower roller member. In operation, the mop head passes between the upper and lower roller members and a quantity of the dust attracting liquid applied thereto. An electric motor is operatively connected to the lower roller member for powered rotation thereof.

8 Claims, 4 Drawing Figures

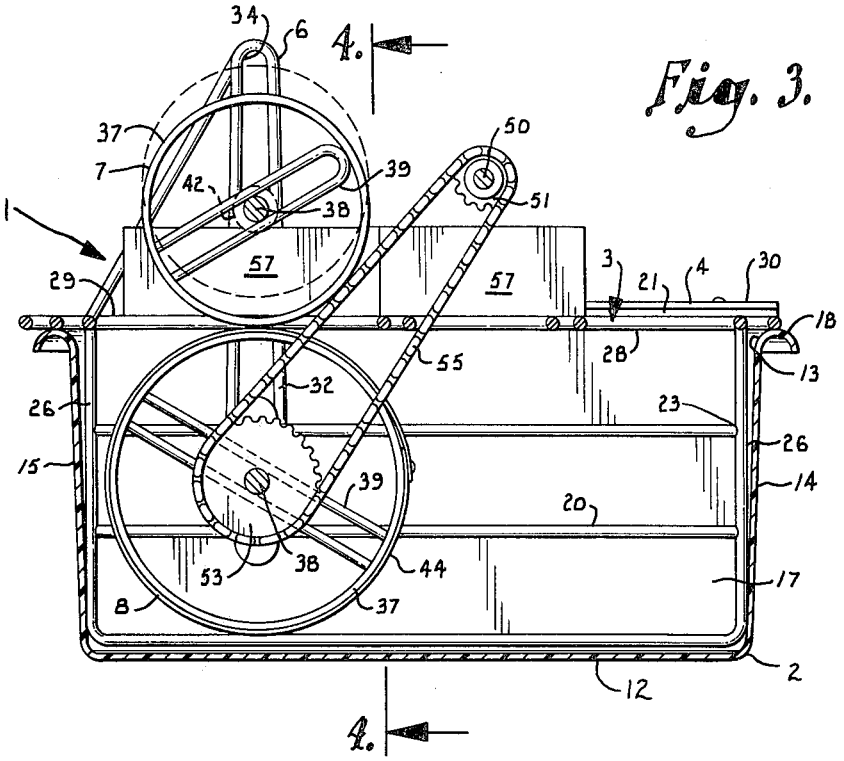
Fig. 3.
Fig. 4.
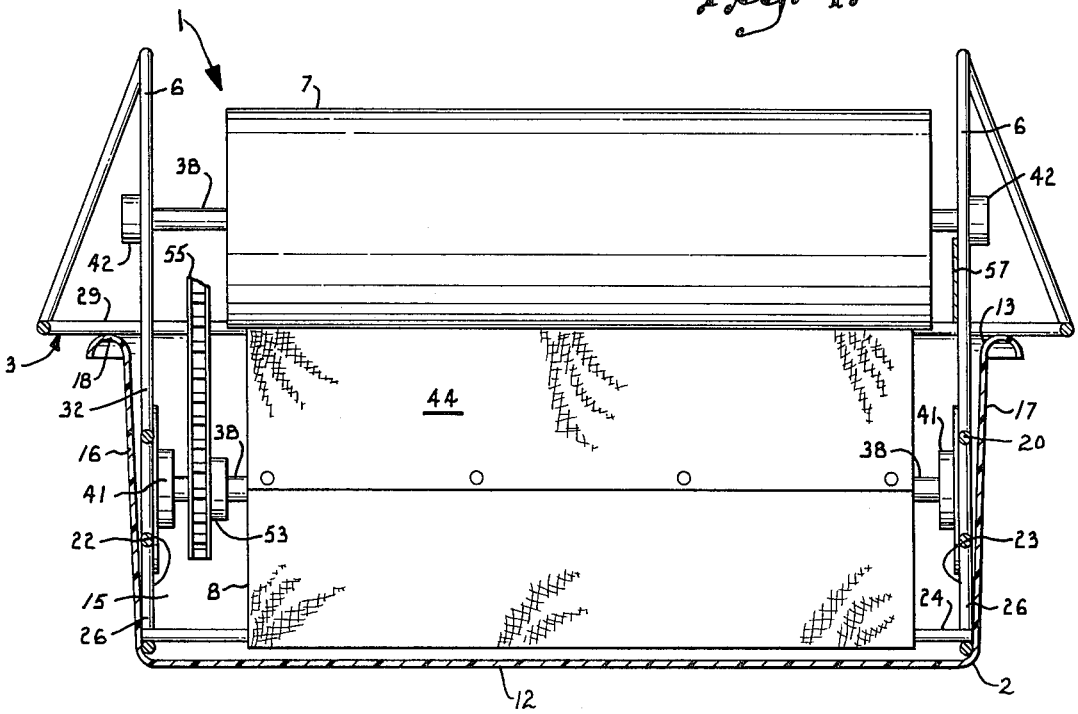

APPARATUS FOR TREATING MOP HEADS AND THE LIKE

This invention relates to treating apparatuses and machines for applying various preparations to mop heads, dust cloths and the like, and in particular, to a lightweight, easily portable treating apparatus utilizing a container and a separable frame structure.

For effective dry moping using cleaning articles such as conventional dust mops, glove type mops, dust cloths and the like, the mop or other article should be treated with a dust attracting material such as specially prepared oils or other suitable liquids which enable the mop or article to effectively pick up and retain the dust, lint or other substance to be removed. Use of such a treated dry mop provides for a longer lasting waxed surface on the floor and a cleaner floor.

Prior dust mop treating machines or apparatuses have been overly bulky and heavy and thereby difficult for janitorial use and moreover, the expense involved in their production and purchase has caused small janitorial services to refrain from purchasing and using such equipment. Ideally, the dust mop or cloth treating machine or apparatus should be easily transportable to the site of use and readily carried to floors in multi-story office buildings by each separate cleaning crew for use therein. Some prior dust mop treating machines employ nozzles and pump to spray liquid onto the mop heads; these nozzles and pumps tend to become clogged with use and must be carefully cleaned.

The principal objects of the present invention are: to provide a mop treating apparatus which is of lightweight construction and easily portable to a job site; to provide such an apparatus having no pumps, nozzles or other devices which tend to become clogged; to provide such an apparatus utilizing an open top container, and a lightweight frame structure easily removable from the container; to provide such an apparatus having a front plate member with transparent portions for visually determining the character and quantity of mop treating material therein; to provide such an apparatus having rollers arranged to receive a mop head therebetween and apply the treating material thereto; to provide such an apparatus having a lower roller with a removable and replaceable cover for picking up the material and applying same to the mop head; to provide such an apparatus with a roller for carrying liquid from the container which includes a roller cover of non-absorbent woven fabric with interstices between fibers for receiving and carrying the treating liquid; and to provide such an apparatus which is relatively inexpensive, sturdy and efficient in use and particularly well adapted for its intended purpose.

Other objects and advantages of this invention will become apparent from the following description taken in connection with the accompanying drawings wherein are set forth, by way of illustration and example, a certain embodiment of this invention.

FIG. 3 is a sectional view taken along lines 3—3, FIG. 2.

FIG. 4 is a longitudinal sectional view of the treating apparatus taken along lines 4—4, FIG. 3.

Figure 1:
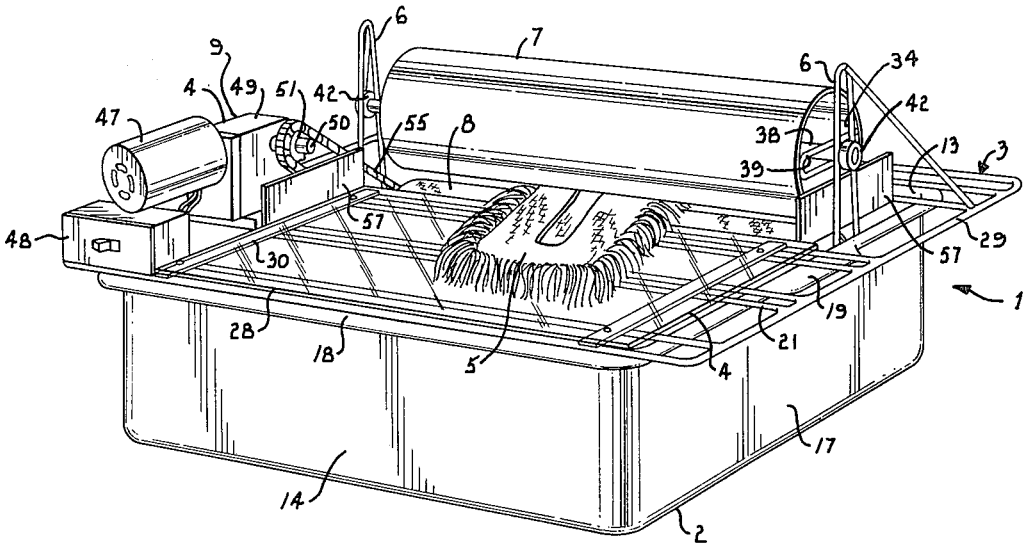
FIG. 1 is a front perspective view of an apparatus for treating mop heads and the like embodying the present invention with a mop head in treating position.
Figure 2:
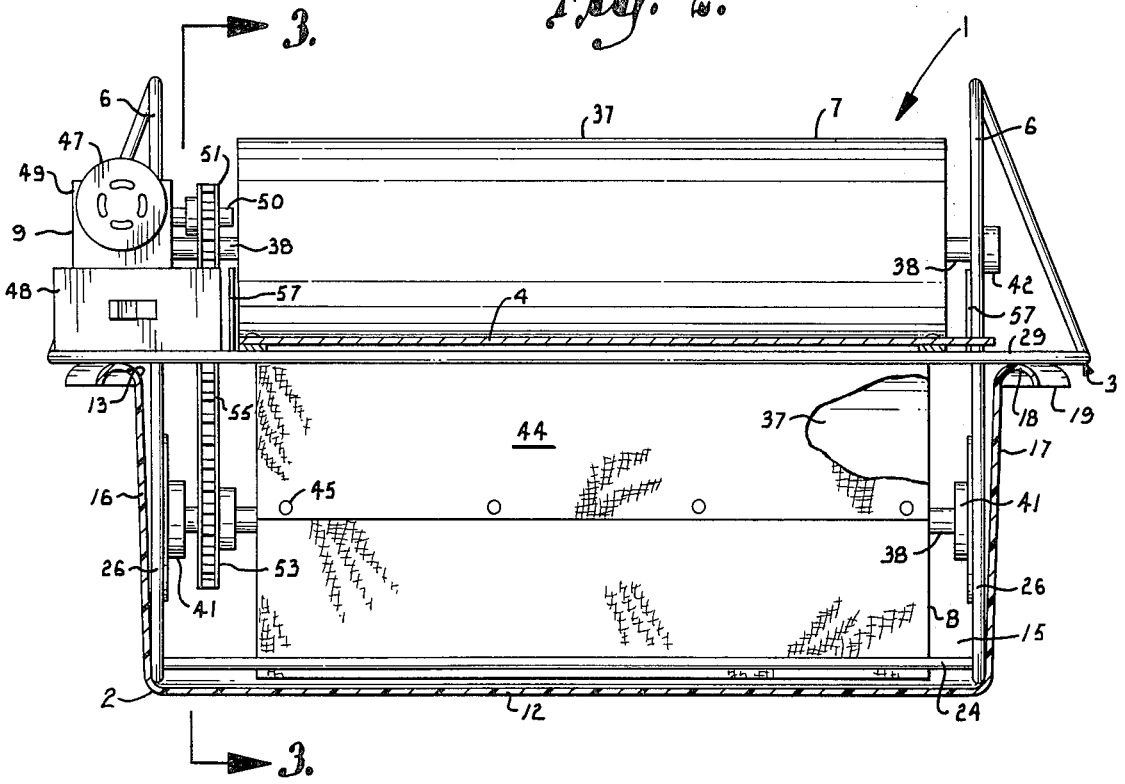
FIG. 2 is a front elevational view of the apparatus and having a front wall of the container broken away to show details of the apparatus positioned therein.

As required, a detailed embodiment of the present invention is disclosed herein, however, it is to be understood that the disclosed embodiment is merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail

The reference numeral 1 generally indicates an apparatus for treating dust mops and the like embodying the present invention. The apparatus includes an open top container with a liquid applying mechanism supported thereon. The mechanism includes rotatably supported upper and lower rollers and a plate-like member over which a mop head or the like with mop strands down is moved to pass between said upper and lower rollers. The lower roller is driven to move the mop head and said lower roller receives liquid from a quantity in the container and applies it to the mop head strands at a constant rate. The apparatus 1 utilizes a lightweight container 2 having a closed bottom and an open top and bounded by spaced front and rear walls and side walls providing an interior for holding a quantity of a dust attracting liquid material for treating a mop head. A lightweight, removable frame structure 3 is supported in an overlying relation fitted onto the container 2 and has a front portion with a supportive member 4 horizontally mounted thereon for supporting a portion of a cleaning article such as a mop head 5. A rear portion of the frame structure 3 includes spaced arm members 6 having lower portions extending downwardly into the interior of the container 2 and upper portions extending upwardly from the container. Horizontally disposed upper and lower roller members 7 and 8 are rotatably supported on the arm members 6, the lower roller member 8 being supported on lower portions of the arm members 6 whereby said roller extends into the container 2 to pick up the dust attracting liquid. The upper roller member 7 includes means mounting same to the upper portions of the arm members 6 for movement toward and away from contact with the lower roller member 8. In operation, the mop head 5 is passed between the upper and lower roller members 7 and 8 and a quantity of liquid applied thereto. Motive means 9 cause rotation of the upper and lower rollers 7 and 8 to effect passage of the mop head 5 therebetween and application of the liquid.

In the illustrated example, the container 2 is relatively shallow and has a bottom wall 12 and an open top 13 bounded by spaced front and rear walls 14 and 15 and spaced side walls 16 and 17 providing an interior holding a quantity of a dust attracting liquid material for treating cleaning article such as a mop head, glove mop, dust rag or the like. The dust attracting liquid may be an oil such as a high grade petroleum based, mineral seal oil having a relatively high flash point. The oil may be treated with a suitable biocide or bacteriostatic material and further can have a pleasant odor to freshen the air. The walls 14, 15, 16 and 17, in the illustrated example, are rounded at an upper portion thereof providing a continuous supportive ledge 18 around the container 2. Handles 19 are formed on side walls 16 and 17.

The container 2 is preferably formed of a suitable material such as metal or plastic and in the illustrated example, is of plastic resinous material such as polyethylene, vinyl or the like for providing a container 2 having semi-resilient walls for a purpose later described. The exemplary container 2 may be of a size and shape easily commercially obtainable and thereby relatively inexpensive for replacement.

The frame structure 3 is preferably selectively readily separable from the container 2 and in the illustrated example, is comprised of a plurality of elongate rod members 20 which provide a skeletonal structure having a generally planar top frame portion 21 for extending horizontally across the top of the container 2, spaced side frame portions 22 and 23 and braces 24 which extend between the side frame portions 22 and 23 and provide rigidity therefor. The rod members 20 are connected, as by welding, to form the various frame portions and preferably all welds are smoothed so lint or mop threads do not catch thereon. The rod members 20 may be plated, plastic coated or otherwise finished for prevention of rust and to provide a clean or sparkling appearance.

Spaced leg members 26 extend downwardly from the top frame portion 21 and into the interior of the container 2 at respective corners thereof whereby the leg members 26 engage with the walls 14, 15, 16 and 17 and selectively hold the frame structure 3 in fixed position with the top frame portion 21 atop the container 2. In the illustrated example, the front, rear and side walls are slightly inclined upwardly and outwardly providing a taper which with the resiliency of the plastic material of the container 2 grips the leg members 26 for positive separable engagement of the frame structure 3 and container 2.

The frame structure 2 has front and rear portions 28 and 29 respectively adjacent the container front and rear walls 14 and 15. The supportive member 4 is mounted on the front portion 28 generally in a horizontal relation for supporting a portion of the mop head 5 prior to treatment and passage between the upper and lower rollers 7 and 8. In the illustrated example, the supportive member 4 is a transparent plate member preferably formed of a rigid material such as Plexiglas or Lexan for visually determining the character and quantity of liquid within the container 2. The supportive member 4 is mounted atop the top frame portion 21 at the front portion 28 thereof and mounting strips 30 adjacent margins of the supportive member 4 are suitably fastened to underlying rod members 21 to secure the supportive member 4 thereon.

The exemplary spaced arm members 6 are connected to the frame structure 3 generally at the rear portion 29 thereof and in the illustrated example have lower portions 32 extending downwardly into the interior of the container 2 and upper portions 33 extending upwardly from the container. The arm members 6 are respectively positioned adjoining each of the frame structure side walls 16 and 17 and are formed of elongate rod members suitably formed to provide interior ways 34 for a purpose later described.

The upper and lower roller members 7 and 8 are horizontally disposed and rotatably mounted to the arm members 6. In the illustrated example, the lower roller member 8 is rotatably supported on the lower portions 32 and at least partially extends into the liquid in the interior of the container 2 for contacting and picking up the dust attracting liquid. Each of the roller members 7 and 8 includes an elongate, cylindrical drum 37 and an axial shaft 38 extending coaxially through the drum 37 and beyond opposite ends thereof and secured thereto, as by connecting rod members 39. The drum 37 of the lower roller member 8 is preferably greater in diameter than the drum of the upper roller 7. Opposite ends of the axial shaft 38 of the lower roller member 8 are mounted in bearing members 41 suitably secured to the arm member lower portions 32 at a height so that the outer surface of the drum portion 37 is disposed above the bottom 12 of the container.

The upper roller member 7 is rotatably and movably supported relatively to the upper portions 33 of the arm members 6 for movement toward and away from contact with the lower roller member 8 whereby the mop head 5 passes between the upper and lower roller members 7 and 8 and liquid is applied thereto from the lower roller member 7. In the illustrated example, opposite end portions of the upper roller member axial shaft 38 extend through the respective ways 34 whereby the upper roller member 7 is positioned between the arm members 6 and free for guided up and down movement by the ways 34, as indicated in FIG. 3, to permit passage of the mop head 5 between the upper and lower roller members 7 and 8. Endwise movement of the upper roller 8 is limited by collars 42 or other shoulder members fixed on the shaft 38 adjacent to the arm member 6.

In the illustrated example, the drum 37 of the upper roller member 7 has a smooth outer surface and the drum 37 of the lower roller member 8 includes means for picking up or absorbing the dust attracting liquid within the container 2 for applying the liquid to the mop head 5. In the illustrated example, such means include a cloth roll cover 44 fitted onto the drum 37. The exemplary cover 44 is removable and replaceable and has suitable fasteners such as snaps or rivets 45 to secure the cover 44 on the drum portion. The cloth roll cover 44 provides a drive friction between the roller members 7 and 8 and helps to pick up the dust attracting liquid from the container 2 and continuously apply the liquid to the bottom, floor contacting surface of the mop head 5 during rotation of the lower roller member 8. Preferably the cover 44 is a fabric of spun polyester fibers, for example a fabric of twill weave, the weave and fibers are such that the oil is not absorbed into the fibers but only picked up or carried in the fabric interstices. The cover 44 may be changed to provide a different fabric and thereby vary the quantity of oil picked up or carried thereby. A variation in the size of the fiber and weave will provide different size interstices and thereby provide a different rate of liquid lift and application. A certain weave of fabric will provide a constant rate of application and it is preferred that the rate is between 20 and 40 percent of the dry weight of the mop.

The apparatus 1 includes motive means causing rotation of the upper and lower roller members 7 and 8 and passage of the mop head 5 therebetween. In the illustrated example, only the lower roller member 8 is rotatably driven and causes rotation of the upper roller member 7 by contact therewith. The upper roller member 7 is not directly driven but serves as a weight to force the mop head 5 to move thereunder and movement of the mop head 5 or the lower roller member 8 causes the upper roller member 7 to rotate. Various motive means such as hand cranks and the like may be utilized and in the illustrated example, an electrical motor 47 is mounted on the top frame portion 21 and adjacent the side frame portion 22 whereby the motor 47 is disposed to the side of the supportive member 4 and out of the path of the mop head 5. An electrical switch unit 48 is positioned adjacent the motor 47 and suitably electrically connected thereto for routing current to the motor. A suitable speed reducer such as a gear box 49 having suitable internal gearing is joined to the motor 47 and a shaft 50 extends from a side of the gear box 49 generally toward the supportive member 4 and has a first sprocket mounted thereon. To effect powered rotation of the lower roller member 8, the axial shaft 38 of the roller member 8 has a second sprocket 53 of larger diameter than the first sprocket 51 for a desired drive reduction and is mounted coaxially on the shaft 38 adjacent the bearing member 41 and the side frame portion 22. An endless drive chain member 55 extends between and is connected to the first and second sprockets 51 and 53 for powered rotation of the lower roller member 8.

Rotation of the lower roller member 8 through the liquid in the container 2 and application of the liquid to the mop head 5 may cause splashing or spray of the liquid and to confine splash or spray, splash plates 57 respectively are positioned adjacent the arm member 6 by the side frame portion 23 and the drive chain member 55.

In the employment of the apparatus 1, an article such as a dust cloth, glove mop, or mop head 5 is to be treated. Such a mop head 5 may be from four to eight inches in width and of any suitable length such as from 12 to 14 inches. A quantity of the treating liquid is poured into the container 2 and the frame structure 3 fitted to the container 2 as described above. The electrical switch unit 48 is actuated to operate the motor 47 and cause rotation of the lower roller member 8 whereby the liquid collects on the cloth roll cover 44 during rotation. The mop head 5 is inserted between the upper and roller members 7 and 8 at a front of the apparatus 1 and the mop head 5 is pulled between the roller members 7 and 8, as indicated in FIG. 1, thereby continuously applying a quantity of the dust attracting liquid to the undersurface of the mop head 5. Preferably the amount of liquid constitutes approximately 30% of the dry weight of the mop head and the liquid is applied to the floor contacting undersurface of the mop head 5, thereby selectively applying the liquid to the proper portion of the mop head. As the mop head 5 enters between the rollers 7 and 8, the upper roller member 7 moves upwardly in the ways 34 to accomodate the mop head 5 therebetween and apply downward weight or pressure to press the mop head 5 against the cloth roll cover 44 to absorb liquid.

As the mop head 5 exits from between the upper and lower roller members 7 and 8, the mop head slides rearwardly for easy grasping by the operator. Thus, the dust attracting liquid is continuously rolled onto the mop head undersurface at a controlled rate to reduce waste of the liquid and insure cleanliness of the operation. Preferably, the motor 47 and drive arrangement is such that the linear speed of the lower roller member 8 is relatively high, such as 40 feet per minute so that treatment of a plurality of mop heads 5 is relatively rapid.

It is to be understood that while a form of this invention has been illustrated and described, it is not to be limited to the specific form or arrangement of parts herein described and shown, except insofar as such limitations are included in the following claims.

What is claimed and desired to secure by Letters Patent is:

1. A lightweight, easily portable apparatus for treating a fabric cleaning article with a dust attracting material comprising:

(a) a container having a bottom and spaced walls therearound including front, rear and side walls with interior surfaces providing an open top with upper edges for holding a quantity of dust attracting material for treating a cleaning article;

(b) a frame structure separable from said container and having an upper portion generally covering said open top and a lower portion gripping the walls of said container to provide attachment thereto;

(c) spaced arm members connected to said frame structure adjacent said rear wall and having lower portions extending downwardly into the interior of said container and upper portions extending upwardly from said container;

(d) upper and lower rollers horizontally disposed and rotatably supported by said arm members, the lower roller generally positioned within said container and having a portion contacting and picking up dust attracting material, said upper roller being generally positioned above the level of the upper edges of said container and mounted for movement in said arm members toward and away from contact with said lower roller whereby a cleaning article is passed between said upper and lower rollers and a quantity of dust attracting material applied thereto;

(e) a supportive plate member secured to said frame structure and positioned forwardly of said upper and lower rollers, said plate member having a front edge terminating generally adjacent the upper edge of the front wall and a rear edge terminating adjacent the juncture of said upper and lower rollers for supporting said cleaning article thereon and passing the cleaning article between said upper and lower rollers; and (f) means mounted on said frame structure and connected to one of said upper and lower rollers for effecting rotation thereof and passage of the cleaning article therebetween.

2. The apparatus set forth in claim 1 wherein:

(a) said supportive plate member is transparent for visually determining the quantity of dust attracting material in said container.

3. The apparatus set forth in claim 1 wherein:

(a) said container is formed of resilient plastic material and said upper edges provide a supportive ledge around said container; and (b) said frame structure includes a plurality of elongate rod members generally supported on said ledge in overlying relation to said container, said frame structure having spaced leg members inserted downwardly and into the interior of said container and into resilient, gripping engagement with said interior surfaces of said walls for selectively holding said frame structure in a fixed yet separable position atop said container.

4. The apparatus set forth in claim 1 wherein:

(a) said arm members include ways in said upper portions;

(b) said upper roller includes an axial shaft having opposite ends;

(c) said shaft ends are respectively positioned in said ways for upward and downward movement of said upper roller relative to said lower roller.

5. The apparatus set forth in claim 1 including:

(a) a non-absorbent fiber covering with interstices therein on said lower roller to aid in picking up the dust attracting material and depositing said material on the cleaning article.

6. The apparatus set forth in claim 5 wherein:

(a) said covering is a removable and replaceable fabric cover having a weave defining said interstices to pick up said dust attracting material.

7. The apparatus set forth in claim 1 wherein:

(a) said means for rotating said rollers include an electric motor mounted on said frame structure and operably connected to said lower roller for providing powered rotation thereof.

8. A lightweight, easily portable apparatus for treating a mop head with a dust attracting material comprising:

(a) a relatively shallow and lightweight plastic container having a closed bottom and an open top and bounded by spaced front and rear walls and side walls providing an interior holding a quantity of a dust attracting material for treating a mop head, said walls having an upper portion providing a supportive ledge around said container;

(b) a removable frame structure having a plurality of elongate rod members and generally supported on said ledge in separable overlying relation to said container, said frame structure having spaced leg members inserted downwardly and into the interior of said container and into resilient, gripping engagement with said walls for selectively holding said frame structure in fixed position atop said container, said frame structure having front and rear portions respectively adjacent said container front and rear walls;

(c) a transparent plate member mounted in horizontal, overlying relation to said front portion and generally extending between the side walls of said container for supporting the mop head thereon and visually determining the quantity of dust attracting material in said container;

(d) upper and lower roller members horizontally disposed and rotatably supported relative to the rear portion of said frame structure, said rear portion having spaced arm members respectively positioned adjacent said side walls and having lower portions extending downwardly into the interior of said container an having upper portions providing ways and extending above said container; the lower roller member axially and rotatably supported and fixed in relative position to said lower portions of said arm members whereby at least a portion of said lower roller contacts the dust attracting material; the upper roller member having opposite axial shaft end portions mounted to said upper portions of said arm members and movable upwardly and downwardly in said ways into and out of contact with said lower roller member for passage of the mop head therebetween;

(e) a removable and replacement cloth cover on said lower roller member, the cloth cover having weave with interstices therein to pick up the dust attracting material from said container and deposit said material on the mop head; and (f) a motor on said frame structure and having an endless chain member extending between said motor and said lower roller member for rotatably driving said lower roller member whereby said mop head is pulled between said roller members and a quantity of dust attracting material continuously applied to said mop head by said cloth cover.

* * * * *